US006910911B2

(12) United States Patent
Mellott et al.

(10) Patent No.: US 6,910,911 B2
(45) Date of Patent: Jun. 28, 2005

(54) BREAK-AWAY ELECTRICAL CONNECTOR

(75) Inventors: Mark Bradford Mellott, Pittsburgh, PA (US); Douglas Mark Zatezalo, Allison Park, PA (US); James Randall Logan, Pittsburgh, PA (US); Ryan Anthony Zoschg, Oakmont, PA (US); Michael Davis, White Oak, PA (US); Graham Keith Lacy, London (GB); Steven McLellan, London (GB); Ian Heseltine, London (GB)

(73) Assignee: Vocollect, Inc., Pittsburgh, PA (US)

( * ) Notice: Subject to any disclaimer, the term of this patent is extended or adjusted under 35 U.S.C. 154(b) by 0 days.

(21) Appl. No.: 10/185,300

(22) Filed: Jun. 27, 2002

(65) Prior Publication Data

US 2004/0002243 A1 Jan. 1, 2004

(51) Int. Cl.[7] ..... H01R 13/627

(52) U.S. Cl. ..... 439/358; 439/180; 439/341; 439/923

(58) Field of Search ..... 439/180, 358, 439/357, 289, 700, 824, 37, 822, 341, 376, 923

(56) References Cited

U.S. PATENT DOCUMENTS

| | | | | | |
|---|---|---|---|---|---|
| 1,753,317 | A | | 4/1930 | Rothen | |
| 2,170,287 | A | | 8/1939 | Kinnebrew | 173/330 |
| 2,369,860 | A | * | 2/1945 | Schroeder | 439/289 |
| 3,363,214 | A | | 1/1968 | Wright | 339/12 |
| 3,781,039 | A | | 12/1973 | Locke et al. | 285/1 |
| 3,808,577 | A | | 4/1974 | Mathauser | 339/12 |
| 4,068,913 | A | | 1/1978 | Stanger et al. | 339/111 |
| 4,619,491 | A | | 10/1986 | Drogo | 339/45 |
| 4,620,760 | A | | 11/1986 | Duncan | 339/45 |
| 4,649,332 | A | | 3/1987 | Bell | 320/7 |
| 4,698,717 | A | | 10/1987 | Scheid | 361/1 |
| 4,846,714 | A | | 7/1989 | Welsby et al. | 439/348 |
| 4,874,316 | A | | 10/1989 | Kamon et al. | 439/39 |
| 5,024,604 | A | | 6/1991 | Savin et al. | 439/345 |
| 5,371,679 | A | | 12/1994 | Abe et al. | 364/468 |
| 5,393,239 | A | | 2/1995 | Ursich | 439/180 |
| 5,399,102 | A | | 3/1995 | Devine | 439/505 |
| 5,456,611 | A | | 10/1995 | Henry et al. | 439/180 |
| 5,462,452 | A | | 10/1995 | Devine | 439/505 |
| 5,478,252 | A | | 12/1995 | Lecomte et al. | 439/180 |
| 5,480,313 | A | | 1/1996 | d'Alayer de Costemore d'Arc | 439/159 |
| 5,501,571 | A | | 3/1996 | Van Durrett et al. | 414/786 |
| 5,639,256 | A | * | 6/1997 | Endo et al. | 439/358 |
| 5,803,750 | A | | 9/1998 | Purington et al. | 439/17 |
| 5,934,911 | A | | 8/1999 | Stout et al. | 439/21 |
| 5,941,726 | A | * | 8/1999 | Koegel et al. | 439/358 |
| 5,941,729 | A | | 8/1999 | Sri-Jayantha | 439/505 |
| 5,984,709 | A | | 11/1999 | Zink et al. | 439/348 |
| 5,993,246 | A | | 11/1999 | Moldenhauer et al. | 439/474 |
| 6,022,237 | A | | 2/2000 | Esh | 439/348 |
| 6,062,891 | A | | 5/2000 | Villiers | 439/348 |
| 6,149,451 | A | * | 11/2000 | Weber | 439/358 |

(Continued)

FOREIGN PATENT DOCUMENTS

| | | | |
|---|---|---|---|
| DE | 4111049 | 10/1991 | H01R/13/71 |

*Primary Examiner*—Tho D. Ta
*Assistant Examiner*—Felix O. Figueroa
(74) *Attorney, Agent, or Firm*—Wood, Herron & Evans, L.L.P.

(57) ABSTRACT

An electrical connector has a plug portion and a terminal portion. The plug portion is couplable to the terminal portion to provide an electrical connection between a device and a peripheral item which is securely coupled to the device during normal operation of the device. Advantageously, the plug portion will break-away from the terminal portion when a force applied to the plug portion reaches a specified magnitude to thereby prevent damage to the connector and to prevent hindering operation of the device.

33 Claims, 6 Drawing Sheets

U.S. PATENT DOCUMENTS 6,226,622 B1 5/2001 Dabbiere ..... 705/28
6,237,051 B1 5/2001 Collins ..... 710/36
6,304,436 B1 10/2001 Branch et al. ..... 361/683
6,310,888 B1 10/2001 Hamlin ..... 370/466
6,339,764 B1 1/2002 Livesay et al. ..... 705/28
6,364,675 B1 4/2002 Brauer et al. ..... 439/159
6,454,608 B1 * 9/2002 Kitahara et al. ..... 439/358

* cited by examiner

BREAK-AWAY ELECTRICAL CONNECTOR

FIELD OF THE INVENTION

This invention relates generally to connectors and more specifically, to connectors having use with wearable, portable and/or mobile computer terminals and peripherals.

BACKGROUND OF THE INVENTION

Wearable, portable and/or mobile computer terminals are used for a wide variety of tasks. Such terminals allow a worker using them to have mobility, while providing them with desirable computing and data-processing functions. Furthermore, various terminals provide a communication link to a larger, more centralized computer system. Such terminals are being implemented for an ever-increasing number of tasks.

One illustrative example of a specific use for a wearable or portable terminal is inventory management. Computerized inventory management systems are used in inventory-driven industries for various tasks, such as food and retail product distribution, manufacturing, and quality control. An overall integrated inventory management system involves a combination of a central computer system for tracking and management, and the people who use and interface with the computer system in the form of order fillers, pickers and other workers. The workers handle the manual aspects of the integrated management system.

To provide an interface between the central computer system and the workers, wearable or portable computers or terminals are used by the workers as they complete their numerous tasks. Such wearable terminals, for example, pull information directly from the central system and translate the information into voice or text commands for the workers. Through wireless radiofrequency (RF) networks, the commands to and responses from the workers are communicated between the system and the terminals. To communicate in a voice-driven system, for example, the worker wears a headset which is coupled to their wearable terminal. Through the headset, the workers are able to receive voice instructions, ask questions, report the progress of their tasks, and report working conditions, such as inventory shortages, for example. Using such terminals, the work is done virtually hands-free without equipment to juggle or paperwork to carry around.

In addition to headsets, other peripherals are often coupled to the terminals depending upon the tasks to be performed. For example, bar code readers and other scanners may be utilized alone or in combination with a headset to communicate back and forth with the system.

An illustrative example of a job through a system utilizing wearable and/or portable terminals having voice capabilities may involve initially welcoming the worker to the system and defining a particular task or order, for example, a load to be filled for a certain truck to depart from a warehouse. The worker may then answer with a particular area (e.g., freezer) that they will be working in for that order. The system then vocally directs the worker to a particular aisle and bin to pick a particular quantity of an item. The worker then vocally confirms their location and the amount of items that are picked. The system may then direct them to a loading dock or bay for a particular truck to receive the order. As may be appreciated, various different scenarios might be played out through the system using a wearable terminal and attached peripherals.

The peripherals, such as a headset, are attached to a terminal with a cord which extends generally from the terminal (typically worn on a belt) to the head of the worker where the headset is located. As may be appreciated, the workers are moving rapidly around their work area and are often jumping on and off forklifts, pallet loaders, and other equipment. Therefore, there is a possibility for a cord to get caught on some object, such as a forklift. When this occurs, the cord will tend to want to separate either from the headset or from the terminal. Generally, the cords are permanently attached to a headset and each worker maintains their own headset (e.g. for individual responsibility and/or hygiene purposes). The cords are then plugged into the terminals, therefore the separation will generally occur at the terminal socket.

Attempts have been made to appropriately handle a snagged cord and cord separation. However, there are competing issues that must be addressed. When the cord plug is strongly secured to the terminal socket, a snagged cord may pull the socket out of the terminal housing. This may render the terminal inoperable and require repair or replacement. However, strengthening the anchoring point of the socket in the terminal may lead to cords pulling away from their plug, thus rendering the headset unusable. Making the cord more securely attached with its plug, making the terminal socket securely anchored in the terminal housing, and then providing a secure coupling between the plug and the socket, however, may prevent separation but may leave the cord susceptible to catching on surrounding objects resulting in damage to the cord and/or the plug.

Therefore, it is desirable to improve upon the interface of a peripheral with a wearable terminal. It is specifically desirable to provide such improvements in an environment where peripherals and their cords may become hung up.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the invention.

DETAILED DESCRIPTION

Although the invention will be described next in relation to certain embodiments, the invention is not limited to practice in any one specific type of portable or wearable terminal. It is contemplated that the principles of the invention can be used with a variety of electronic devices, including but not limited to wearable, portable and/or mobile terminals for use with inventory systems. The description of the invention is intended to cover all alternatives, modifications, and equivalent arrangements as may be included within the spirit and scope of the invention as defined by the appended claims. In particular, those skilled in the art will recognize that the components of the invention described herein could be arranged in multiple different ways.

Figure 1:
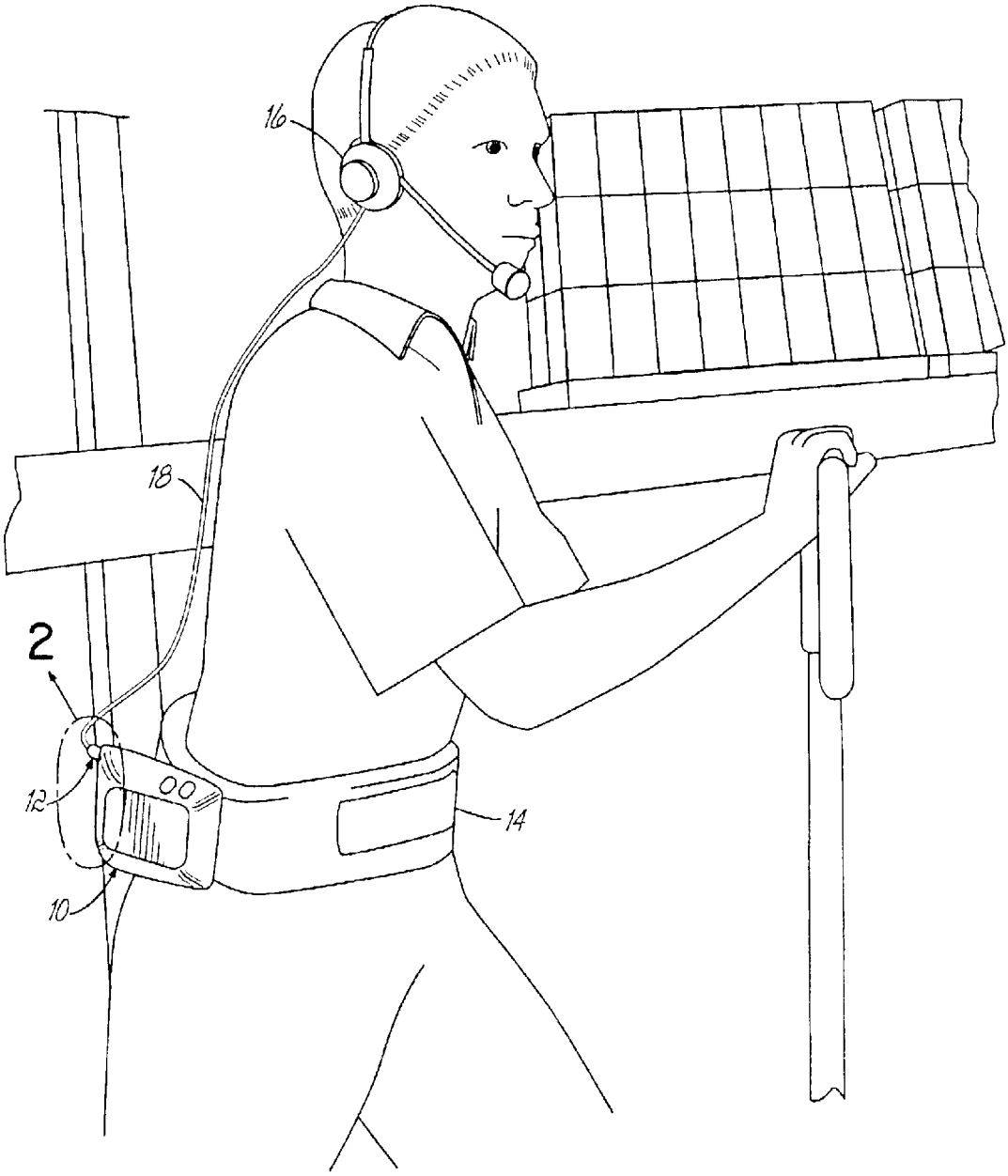
FIG. 1 is an illustration of a wearable terminal incorporating the present invention.

Referring to FIG. 1, there is shown a wearable terminal 10 which incorporates a break-away connector 12 of the present invention. While described herein with regard to a wearable terminal 10, it will be appreciated that the exemplary connector 12 is applicable to other wearable, portable and mobile devices, and is generally applicable to electronic devices connected to peripheral devices by a wire or cord. The wearable terminal 10 may be worn by a worker on a belt 14 and may be connected to a peripheral device 16 such as a voice headset, by a cord 18 that is coupled to the terminal 10 by a breakaway connector 12 in accordance with the principles of the invention. Such wearable terminals 10 may be used in inventory management environments where workers are required to retrieve various items within the warehouse. The wearable terminal 10 and peripheral 16 permit the worker to communicate with a central computer system or other information system to send and receive information regarding the activities performed by the worker and the inventory being managed. To that end, the peripheral device 16 is adapted with a transducer that generates a signal in response to a suitable input and the cord 18 electrically couples the peripheral device 16 with the wearable terminal 10 for transferring the signal from peripheral device 16 to the wearable terminal 10.

In a certain environments in which inventories are managed, the cord 18 connecting the peripheral 16 with the terminal 10 may become snagged or entangled, such as on shelving structures or equipment, for example, used to transport the items collected from the inventory. Therefore, it is desirable to have a connector 12 which provides a secure electrical connection between cord 18 and terminal 10, but which will break away at a specified break-away force whereby the connector becomes uncoupled from the terminal 10 to prevent damage to the terminal 10, peripheral 16 or cord 18.

While an exemplary embodiment is disclosed herein with respect to a voice headset, other peripherals 16 may also be utilized equally with the present invention. For example, bar code readers, scanners, printers and other peripherals which might be coupled to terminal 10 through cord 18 will also benefit from the aspects of the present invention. Furthermore, while an exemplary embodiment is described with respect to use of the invention and a portable terminal 10 in an inventory management environment, the principles of the invention will have equal applicability to other terminals or electronic devices, and other operating environments.

Figure 2:
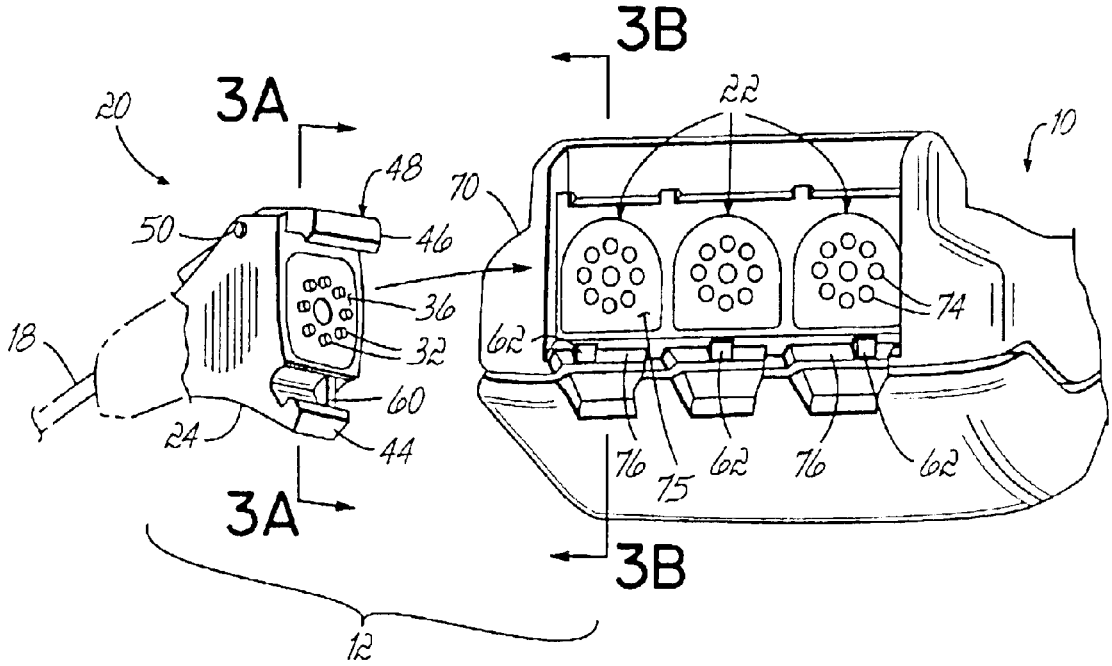
FIG. 2 is an enlarged, exploded view of the encircled area 2 of FIG. 1, depicting an embodiment of the present invention.

FIG. 2 shows detail of the exemplary connector 12 comprising two portions, a plug portion 20 and a terminal portion or socket portion 22. The portions 20, 22 are shown uncoupled in FIG. 2 for clarity. Advantageously, plug portion 20 may be coupled to terminal portion 22 to provide an electric connection between a peripheral device 16 and the wearable terminal 10 via contacts 32, such as pins, on the plug portion 20 and corresponding contacts 74 on the terminal portion 22. The wearable terminal 10 may have a terminal portion for a single connector 12, or may be provided with multiple terminal portions 22 for the coupling of multiple plug portions 20, as depicted in FIG. 2. When multiple connectors 12 are used, the plug and terminal portions 20, 22 may be provided with keys 60 and corresponding keyways or key slots 62, respectively, to ensure that the appropriate plug portion 20 is coupled to its respective terminal portion 22.

Figure 3:
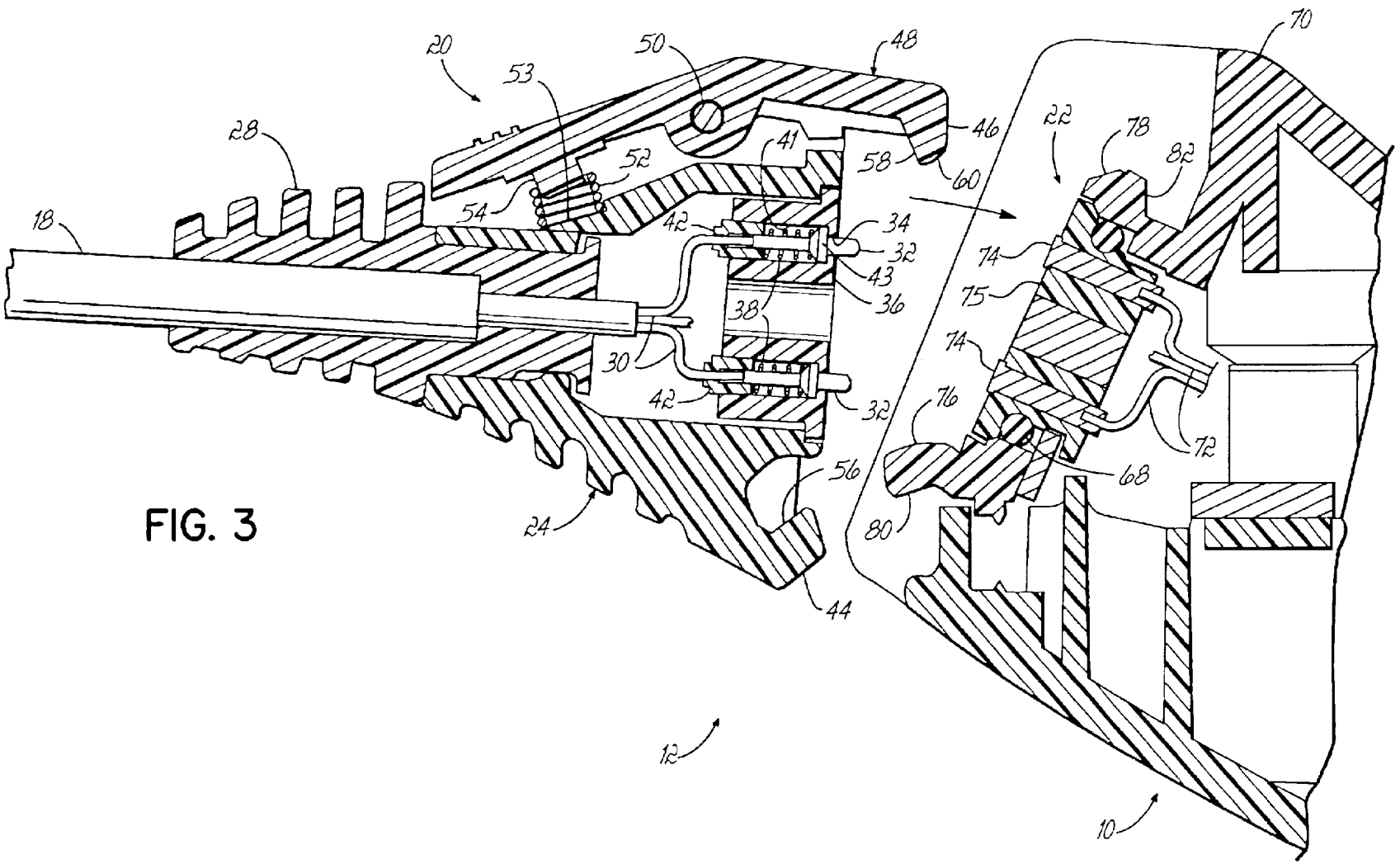
FIG. 3 is a cross-sectional view taken generally along lines 3A—3A and 3B—3B of FIG. 2.
Figure 4:
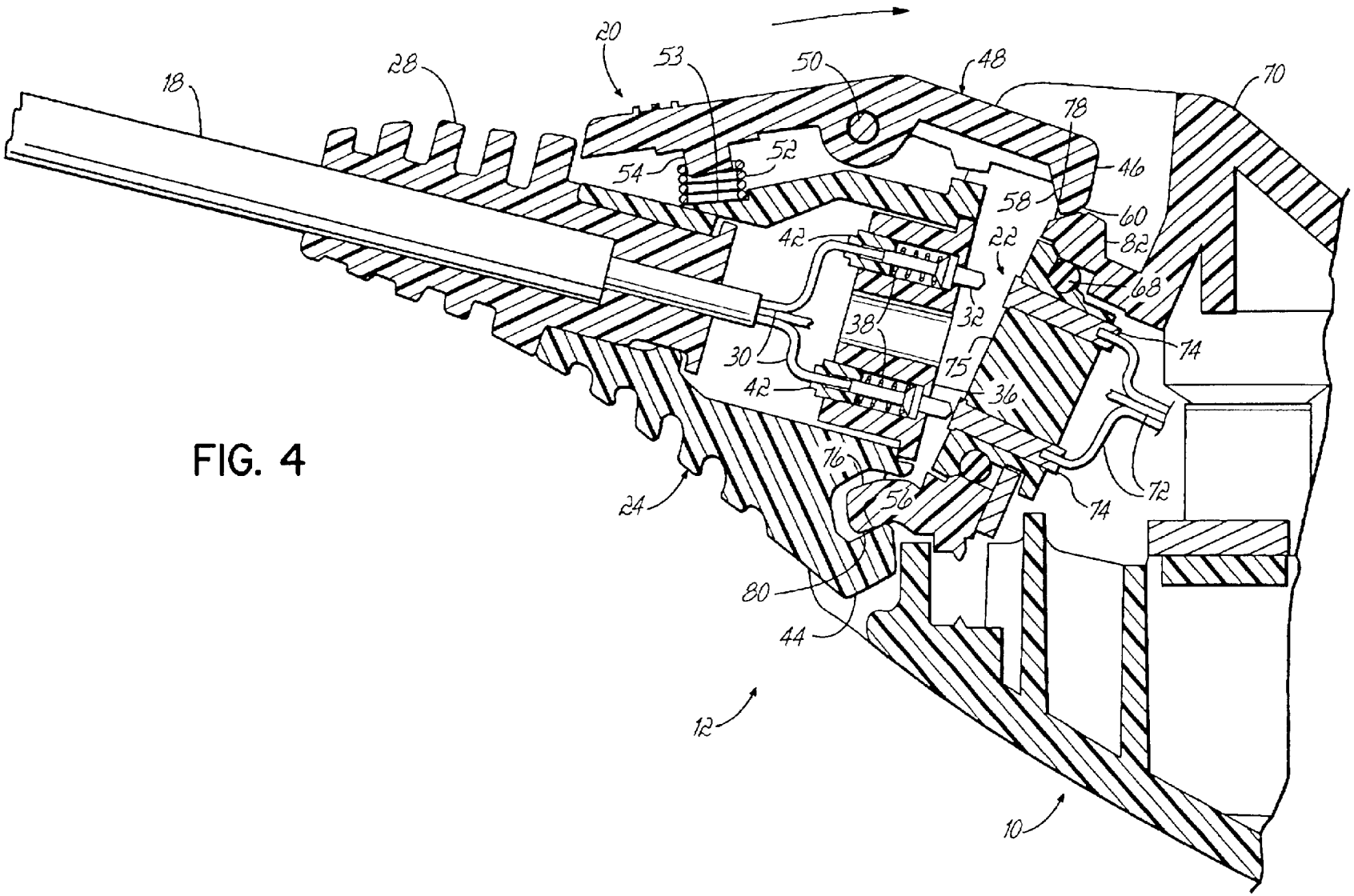
FIG. 4 is a cross-sectional view of the connector of FIG. 3, showing the plug and terminal portions just prior to coupling.
Figure 5:
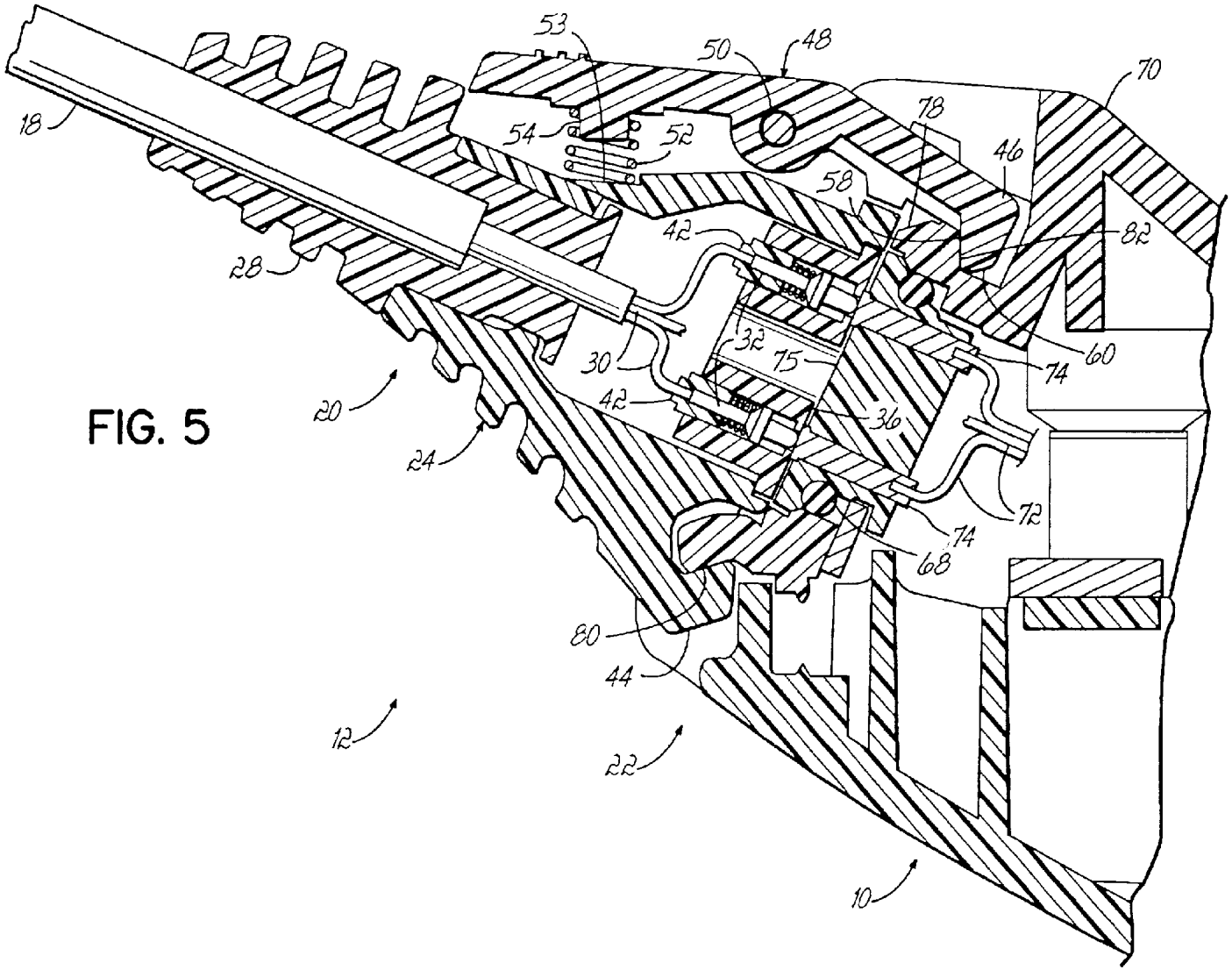
FIG. 5 is a cross-sectional view of the connector of FIG. 3, depicting the plug and terminal portions coupled together.

FIGS. 3–5 show cross-sectional views of the plug and terminal portions 20, 22 of an exemplary electrical connector 12 of FIG. 2. The plug portion 20 includes a plug housing 24 which is configured to be attached to an end of a multi-conductor cord or cable 18. A strain relief 28 provided at one end of the plug housing 24 helps to retain the multi-conductor cord 18 and participates in preventing damage to individual conductors 30 within the cord 18 which may be caused by tension applied to the cord 18.

Individual conductors 30 of the multi-conductor cord 18 are separated within the plug housing 24 and are electrically coupled with respective electrical contacts 32. In the exemplary plug portion 20 shown, the electrical contacts 32 are retractable contacts, such as pogo pin contacts. The contacts 32 protrude through apertures 34 provided in a mating surface 36 of the plug portion 20. The contacts 32 have respective biasing members or springs 38 that bias the pins 32 in a direction toward the mating surface 36, and which also permit the contacts 32 to be displaced such that they are substantially flush with the mating surface 36 when the plug portion 20 couples with the terminal portion.

Each contact 32 is provided with an insert 42, such as a solder cup, that is press-fit into a corresponding cavity 41 provided in the plug housing 24. Each spring 38 is compressed between the insert 42 and a frustoconical portion 43 of the respective contact 32. The insert 42 also electrically couples each conductor 30 of the multi-conductor cord 18 with a corresponding one of the electrical contacts 32. The insert 42 operates to seal off the junction between each conductor 30 and the corresponding contact 32 from moisture infiltrating about the contact 32 into the associated cavity 41.

When the wearable terminal 10 is used in alternatingly warm, humid environments, such as a warehouse or the outdoors, and cold, dry environments, such as a storage freezer, there may be a tendency for the condensation which develops on the connector 12 to freeze, potentially interfering with the electrical contacts. Advantageously, the spring force of the springs 38 on contacts 32 may be selected such that the spring force will break off any ice which may have formed over the contacts 32, when the connector portions are uncoupled and the contacts 32 are moved toward their extended positions by springs 38.

With continued reference to FIGS. 3–5, the plug portion 20 further includes first and second engagement claws 44, 46 which are used to secure the plug portion 20 to the terminal portion 22 in a break-away fashion in accordance with the principles of the present invention. The first engagement claw 44 is provided on one part of the plug housing 24 such as by being formed with the housing, for example. The second engagement claw 46 is provided on a lever arm 48 which is pivotally mounted by a pin 50 to another part of the plug housing 24, such that the second engagement claw 46 is positioned substantially opposite the first engagement claw 44 on the housing 24. A biasing member or spring 52 disposed between the lever arm 48 and the plug housing 24 biases the arm 48 in one direction toward a first position for engaging the terminal portion 22 of connector 12 when coupled thereto. The lever arm 48 may be pivoted in the opposite direction toward a second position for coupling and uncoupling the plug and terminal portions 20, 22 by rotating the lever arm 48 about the pin 50 against the force of spring 52. A protrusion 54 formed into one end of the lever arm 48 helps to retain the spring 52 in position on the plug housing 24 along with a cavity 53 in the housing.

Figure 6:
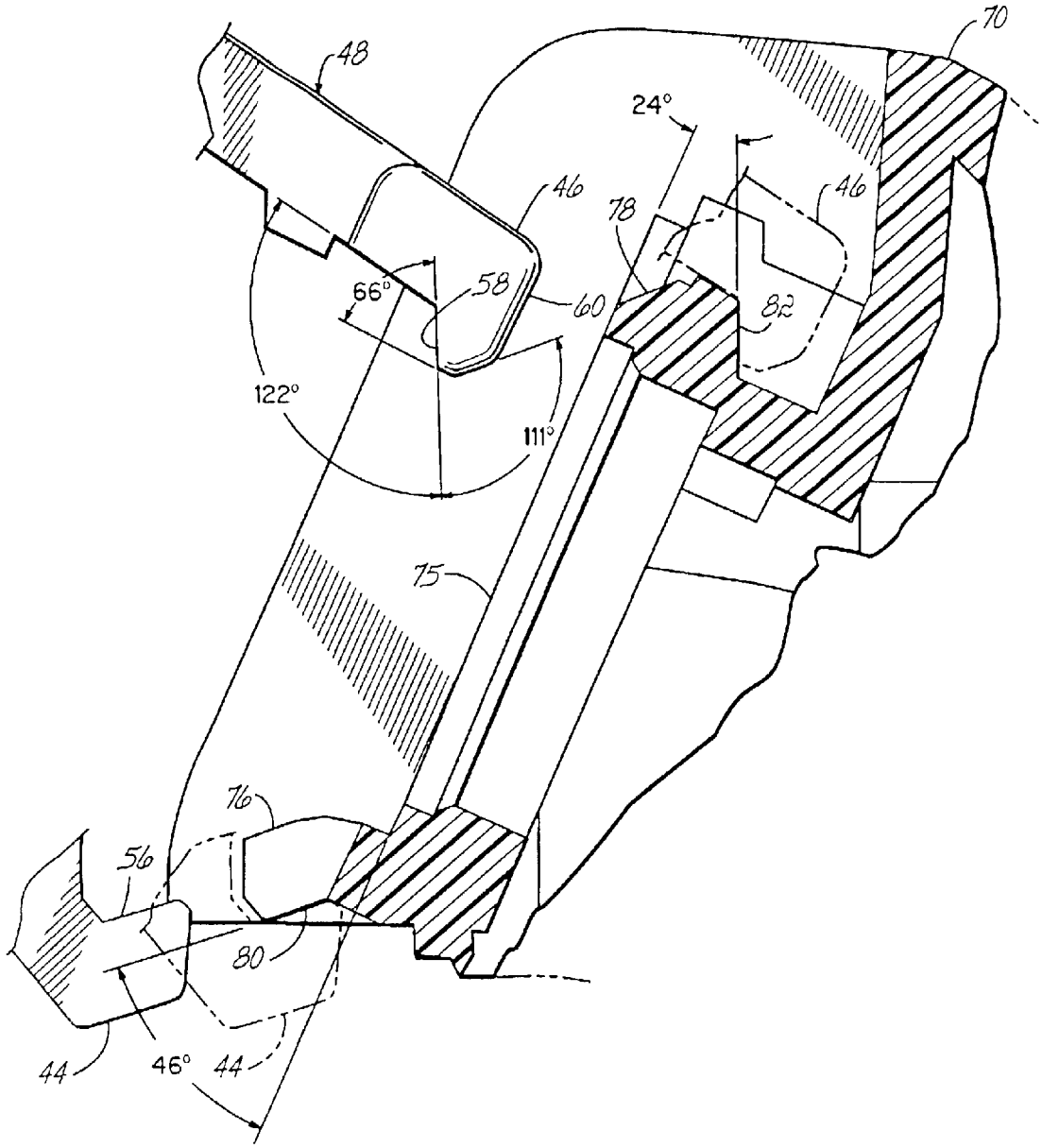
FIG. 6 is a view showing detail of the terminal housing in cross-section and the lever arm and engagement claws in elevation.

The first and second engagement claws 44, 46 have angled surfaces 56, 58, respectively, which facilitate coupling the plug portion 20 with the terminal portion 22. The second engagement claw 46 on lever arm 48 has a leading edge 60 which is angled to facilitate coupling the plug portion 20 with the terminal portion 22, whereby contact between leading edge 60 and the second engagement lip 78 urges lever arm 48 from the first position toward the second position, against the opposing bias force created by spring 52. In an exemplary embodiment, leading edge 60 is angled approximately 111° from a surface parallel to the angled surface 58 of second engagement claw 46, as depicted in FIG. 6. The angled surfaces 56, 58 also permit the plug portion 20 to become uncoupled from the terminal portion 22 when a specified force is applied to the plug portion 20, as will be described more fully below.

With continued reference to FIGS. 3–5, the terminal portion 22 of the electrical connector 12 includes a terminal housing 70 which is configured to mate with the plug housing 24. The terminal housing 70 may be connected to, or formed integrally with the housing of a device, such as wearable terminal 10, with which the electrical connector 12 is used. One or more conductors 72 are routed to the terminal portion 22 and are attached to electrical contacts 74 which are configured to mate with corresponding electrical contacts 32 of the plug portion 20. Therefore, the contacts 74 are arranged generally in the same fashion as the contacts 32 as seen in FIG. 2. In the exemplary electrical connector 12 shown, the electrical contacts 74 have flat ends which protrude just above, but generally flush with, a mating surface 75 of the terminal portion 22 (as opposed to the upraised pins 32) which is configured to interface with the mating surface 36 of the plug portion 20.

As shown in FIGS. 4 and 5, the terminal contacts 74 are configured to mate with the contacts 32 of the plug portion 20 when the plug portion 20 is coupled to the terminal portion 22. An O-ring 68 positioned inside the terminal housing 70 seals the interior of the housing 70 to protect the conductor-contact interface against moisture infiltration. While the contacts 32, 74 shown in the exemplary embodiment are pogo pins and flat contacts configured to mate with the pogo pins, it will be understood that the contacts 32, 74 may be of various other configurations as are known in the art.

As shown in FIGS. 3–5, the terminal housing 70 includes first and second engagement lips 76, 78 which are configured to mate with the first and second engagement claws 44, 46 of the plug portion 20 when the plug portion 20 is coupled to the terminal portion 22. The first and second engagement lips 76, 78 have angled surfaces 80, 82 which correspond to the angled surfaces 56, 58 of the first and second engagement claws 44, 46, respectively, whereby the contact between the first and second engagement claws 44, 46 and first and second engagement lips 76, 78 retains the plug portion 20 on the terminal portion 20, as shown in FIG. 5. When the plug portion 20 and the terminal portion 22 are coupled together, the mating surfaces 36, 75 of the plug and terminal portions 20, 22 interface with one another such that the contacts 32 on the plug portion 20 and the contacts 74 on the terminal portion 22 are in full contact.

Advantageously, the angled surfaces 56, 58, 80, 82 on the first and second engagement claws 44, 46 and on the corresponding first and second engagement lips 76, 78 act in cooperation with the spring 52 on the plug portion 20 to allow the plug portion 20 to break away from the terminal portion 22 when force of a specific magnitude is applied to the plug portion 20. This force may be applied to the plug portion 20 through the cord 18 connected to the plug housing 24, such as when the cord 18 becomes snagged on an object or machine. Accordingly, the angled surfaces 56, 58, 80, 82 on the first and second engagement claws 44, 46 and the first and second engagement lips 76, 78 may be selected, in conjunction with a given spring constant of the spring 52 on the plug housing 24 to permit the plug portion 20 to break away from the terminal portion 22 at a predetermined break-away force. This breakaway force may be applied to the plug portion 20 in any direction, such as normal to the mating surface 36, tangential to the mating surface 36, or generally any angular direction therebetween.

When the force applied to plug portion 20 reaches the predetermined break-away force value, lever arm 48 is caused to rotate about pin 50 toward the second position, whereby plug portion 20 may become uncoupled from terminal portion 22. The relationship between the angled surfaces 58, 82 is such that the relative length dimensions of corresponding surfaces 58 and 82 determine the amount of rotation of lever arm 48 about pin 50 against the force created by the accompanying compression of spring 52.

Advantageously, the break-away force may be specified such that the plug connector portion 20 will remain coupled to the terminal portion 22 during normal operation of the terminal 10, but permits the plug portion 20 to uncouple from the terminal portion 22 when the force applied to the plug portion 20 through the cord 18 reaches the specified break-away force to thereby prevent damage to the electrical connector 12, or to prevent hindering the user of terminal 10. For example, the orientation of the angled surfaces 56, 58, 80, 82 and the spring constant of spring 52 may be selected such that the breakaway force is approximately equal to a force at which cord 18 has been rated to operate without sustaining damage, multiplied by a design factor.

Generally, the force for which the cord 18 is rated to operate without sustaining damage is specified by the manufacturer of the cord. The design factor generally has a value less than 1 and is applied to the rated force to account for variations in material properties, the number of loadings which may be experienced by the cord, the durability of the cord over time, and other considerations which add uncertainty to the determination of a proper rating for the cord. In an exemplary embodiment, cord 18 is rated for about 40 pounds and the design factor is selected to range from about 0.25 to about 0.33, whereby the desired break-away force is about 10 pounds.

With reference to FIG. 6 and in an exemplaiy embodiment, the first engagement claw 44 has an angled surface 56 oriented approximately 46° from the mating surface 36 of the plug portion 20 and the second engagement claw 46 has an angled surface 58 oriented approximately 24° from the mating surface 36 of the plug portion 20 when the lever arm 48 is in the first position, as depicted by phantom lines in FIG. 6. In the exemplary embodiment, the 24° angle of the surface 58 of second engagement claw 46 corresponds to an angle of approximately 122° from a surface which is parallel to a longitudinal axis of lever arm 48, as shown in FIG. 6. The terminal portion 22 of the exemplary embodiment has first and second engagement lips 76, 78 with angled surfaces 80, 82 oriented at approximately 46° and 24°, respectively, from a plane containing the mating surface 75 of the terminal portion 22. When the spring constant of the spring 52 is 81.5 lb/in., the break-away force of the exemplary electrical connector 12 is in the range of approximately 8 to 12 pounds. Of course, other selected break-away force ranges may be used, such as by varying the spring force of spring 52 or the angles of the respective angled surfaces on the engagement claws 44,46 and lips 76, 78. Generally, the break-away force may range from about 3 pounds to about 15 pounds without departing from the spirit and scope of the invention.

The plug housing 24, terminal housing 70, and arm 48 may be formed from polymeric material. In an exemplary embodiment, the plug housing 24, terminal housing 70, and arm 48 are formed from XENOY®, a thermoplastic resin available from GE Plastics, Seven Hills, Ohio. This polymer has good low temperature characteristics useful when the connector 12 is exposed to low temperatures.

With reference to FIGS. 3–5, coupling of the plug portion 20 with the terminal portion 22 will be described. In use, the connector 12 of the present invention may be used to couple a peripheral device 16, such as a headset, to a wearable terminal 10 or other device. The worker depresses lever arm 48 on the plug portion 20 to move the arm 48 toward the second position and brings the first engagement claw 44 on the plug portion 20 into engagement with the first engagement lip 76 on the terminal portion 22. The corresponding keys 60 and keyways 62 will ensure that the proper plug portion 20 is coupled with the proper terminal portion 22. The worker then urges the second engagement claw 46 into engagement with second engagement lip 78, whereby the angled leading edge 60 of the second engagement claw 46 facilitates engagement of the claw 46 with second engagement lip 78. Mating surfaces 36, 75 are brought into substantially abutting relation and contacts 32, 74 are in full contact with one another. The plug portion 20 and terminal portion 22 are fully coupled and the worker may then release lever arm 48. Advantageously, the connector 12 securely couples peripheral 16 to wearable terminal 10 during normal activities of the worker. However, if a cord 18 between peripheral 16 and plug portion 20 should become snagged on an object, the plug portion 20 will become uncoupled from terminal portion 22 when the force applied to plug portion 20 through cord 18 reaches the specific break-away force to thereby prevent damage to terminal 10, connector 12 or cord 18 while allowing a clean beak-away for the worker. The connector 12 may then be easily coupled or re-secured with the terminal 10 for further use.

While the present invention has been illustrated by the description of the various embodiments thereof, and while the embodiments have been described in considerable detail, it is not intended to restrict or in any way limit the scope of the appended claims to such detail. Additional advantages and modifications will readily appear to those skilled in the art. The invention in its broader aspects is therefore not limited to the specific details, representative apparatus and methods and illustrative examples shown and described. Accordingly, departures may be made from such details without departing from the scope or spirit of Applicants' general inventive concept.

What is claimed is:

1. A connector for coupling a terminal connector portion of a terminal with a cord of a peripheral device, comprising:

a plug member capable of being coupled with the cord, said plug member including a non-pivotal first engagement claw having a first angled surface positioned to engage a first complementary angled surface of the terminal connector portion;

a lever arm pivotally mounted on said plug member and movable between a first position for coupling said connector to the terminal connector portion and a second position for uncoupling said connector from the terminal connector portion, said lever arm including a second engagement claw having a second angled surface configured to engage a second complementary angled surface of the terminal connector portion when said lever arm is in said first position; and a biasing member disposed between said plug member and said lever arm for biasing said lever arm toward said first position with a biasing force, wherein said connector uncouples from said terminal connector portion when said second angled surface is engaged with the second complementary angled surface and a break-away force is applied from the cord to said plug member effective to overcome said biasing force and cause said second angled surface to slidingly move relative to the second complementary angled surface thereby pivoting said lever arm from said first position toward said second position without manual actuation of said lever arm.

2. The connector of claim 1, wherein said plug member includes a mating surface, said second angled surface is inclined approximately 46° from said mating surface, said second engagement claw of said lever arm has a third angled surface inclined approximately 24° from said mating surface when said lever arm is in the first position, and said biasing member has a spring constant of about 81.5 lb/in.

3. The connector of claim 1, wherein said connector is configured to uncouple from the terminal connector portion when a magnitude of the break-away force is at least ¼ of a value of a rated damage force of a cord coupled with said plug member.

4. The connector of claim 1, wherein said connector is configured to uncouple from the terminal connector portion when a magnitude of the break-away force is between about 3 pounds and about 15 pounds.

5. The connector of claim 4 wherein said connector is configured to uncouple from the terminal connector portion when the magnitude of the break-away force is between about 8 pounds and about 12 pounds.

6. The connector of claim 1, wherein a leading edge of said second engagement claw of said lever arm has a third angled surface that slidingly contacts a third complementary angled surface on the terminal connector portion when said connector is coupled with the terminal portion, said third angled surface of the engagement claw and the third complementary angled surface of the terminal connector portion moving slidingly relative to each other for facilitating movement of said lever arm from said first position to said second position when coupling said connector with the terminal connector portion.

7. The connector of claim 1, further comprising a peripheral device and a cord electrically coupling said plug member with said peripheral device.

8. The connector of claim 7, wherein said peripheral device includes a headset electrically coupled with said cord.

9. A break-away electrical connector with an attached cord, comprising:

a terminal connector portion, said terminal connector portion comprising:

a terminal housing having first and second engagement lips and a first mating surface, each of said first and second engagement lips including an angled surface, and at least one terminal-side electrical contact disposed proximate said first mating surface; and a plug connector portion adapted to be removably coupled with said terminal connector portion, said plug connector portion comprising:

a plug member capable of being coupled with the cord, said plug member having a non-pivotal first engagement claw with an angled surface configured to engage said angled surface of said first engagement lip and a second mating surface configured to interface with said first mating surface, at least one plug-side electrical contact disposed proximate said second mating surface and electrically coupled with said at least one terminal-side contact when said plug connector portion is coupled to said terminal connector portion, a lever arm pivotally mounted to said plug member and movable between a first position for coupling said plug connector portion to said terminal connector portion and a second position for uncoupling said plug connector portion from said terminal connector portion, said lever arm including a second engagement claw with an angled surface configured to engage said angled surface of said second engagement lip when said lever arm is in said first position, and a biasing member disposed between said plug member and said lever arm for biasing said lever arm toward said first position with a biasing force, wherein said plug connector portion uncouples from said terminal connector portion when said angled surface of said second engagement claw is engaged with said angled surface of said second engagement lip and a break-away force is applied from the cord to said plug member effective to overcome said biasing force and cause said angled surface of said second engagement claw to slidingly move relative to said angled surface of said second engagement lip thereby pivoting said lever arm from said first position toward said second position without manual actuation of said lever arm.

10. The electrical connector of claim 9, wherein said plug connector portion is configured to uncouple from said terminal connector portion when the magnitude of the break-away force is approximately ¼ of a value of a rated damage force of a cord coupled with said plug member.

11. The electrical connector of claim 9, wherein said plug connector portion is configured to break away from said terminal connector portion when the magnitude of the break-away force is between about 3 pounds and about 15 pounds.

12. The electrical connector of claim 9, wherein said plug connector portion is configured to break away from said terminal connector portion when the magnitude of the break-away force is between about 8 pounds and about 12 pounds.

13. The electrical connector of claim 9, wherein said spring constant is approximately 81.5 lb/in.

14. The electrical connector of claim 9, wherein said angled surface of said first engagement claw is inclined approximately 46° from said second mating surface.

15. The electrical connector of claim 9, wherein said angled surface of said first engagement lip is inclined approximately 46° from said first mating surface.

16. The electrical connector of claim 9, wherein said angled surface of said second engagement claw is inclined approximately 24° from said second mating surface when said lever arm is in said first position.

17. The electrical connector of claim 9, wherein said angled surface of said second engagement lip is inclined approximately 24° from said first mating surface.

18. The electrical connector of claim 9, wherein said plug-side electrical contact is a spring-biased pin and said terminal-side electrical contact is a flat pad against which said spring-biased pin is compressively contacting when said terminal and plug connector portions are coupled.

19. The electrical connector of claim 9, wherein a leading edge of said lever arm contacts said terminal housing when said plug member is coupled with said terminal housing for moving said lever arm from said first position to said second position as said plug portion is coupled with said terminal connector portion.

20. An electrical device coupling with a cord of a peripheral device, comprising:

a terminal supporting a voice user interface and including a terminal connector portion with first and second engagement lips each including an angled surface, a first mating surface, and at least one terminal-side electrical contact proximate said first mating surface; and a plug connector portion adapted to couple with said terminal connector portion, said plug connector portion including:

a plug member having a second mating surface configured to interface with said first mating surface, and at least one plug-side electrical contact proximate said second mating surface, said plug member further including a non-pivotal first engagement claw having an angled surface positioned to engage said angled surface of said first engagement lip on said terminal connector portion;

a lever arm pivotally mounted to said plug member and movable between a first position in which said plug connector portion is coupled to said terminal connector portion and a second position in which said plug connector portion is uncoupled from said terminal connector portion, said lever arm including a second engagement claw having an angled surface configured to engage said angled surface of said second engagement lip when said lever arm is in said first position, and a biasing member disposed between said plug member and said lever arm for biasing said lever arm toward said first position with a biasing force, wherein said plug connector portion uncouples from said terminal connector portion when said angled surface of said second engagement claw is engaged with said angled surface of said second engagement lip and a break-away force is applied from the cord to said plug member effective for overcoming said biasing force and moving said angled surfaces of said second engagement claw and said second engagement lip relative to each other to pivot said lever arm from said first position toward said second position without manual actuation of said lever arm.

21. The electrical device of claim 20 wherein said plug connector portion is configured to uncouple from said terminal connector portion when a magnitude of the break-away force is approximately ¼ of the value of a rated damage force of a cord coupled with said plug member.

22. The electrical device of claim 20, wherein said plug connector portion is configured to uncouple from said terminal connector portion when a magnitude of the break-away force is between about 3 pounds and about 15 pounds.

23. The electrical device of claim 20, wherein said plug connector portion is configured to uncouple from said terminal connector portion when a magnitude of the break-away force is between about 8 pounds and about 12 pounds.

24. The electrical device of claim 20, wherein said biasing member has a spring constant which permits said lever arm to move toward said second position when the break-away force is applied from the cord to said plug member.

25. The electrical device of claim 20, wherein said biasing member is a spring having a spring constant of approximately 81.5 lb/in.

26. The electrical device of claim 20, wherein said angled surface of said first engagement claw is inclined oriented approximately 46° from said second mating surface.

27. The electrical device of claim 20, wherein said angled surface of said second engagement lip is inclined approximately 46° from said first mating surface.

28. The electrical device of claim 20, wherein said angled surface of said second engagement claw is inclined approximately 24° from said second mating surface when said lever arm is in said first position.

29. The electrical device of claim 20, wherein said angled surface of said first engagement lip is inclined approximately 24° from said first mating surface.

30. The electrical device of claim 20, wherein said plug-side electrical contact is a spring biased pin for contacting a contact on said terminal connector portion.

31. The electrical device of claim 20, wherein a leading edge of said lever arm has an angled surface that contacts a corresponding angled surface on said terminal housing when said plug connector portion is moved to couple with said terminal connector portion, the contact between said angled surfaces causing said lever arm to move from said first position to said second position.

32. The electrical device of claim 20, further comprising a peripheral device and a cord electrically coupling said plug connector portion with said peripheral device.

33. The electrical device of claim 32, wherein said peripheral device includes a headset electrically coupled with said cord.

* * * * *

UNITED STATES PATENT AND TRADEMARK OFFICE

CERTIFICATE OF CORRECTION

PATENT NO. : 6,910,911 B2
DATED : June 28, 2005
INVENTOR(S) : Mellott et al.

It is certified that error appears in the above-identified patent and that said Letters Patent is hereby corrected as shown below:

Title page,
Item [57], ABSTRACT,
Line 6, change “break-away” to -- break away --.

Column 3,
Line 17, change “breakaway” to -- break-away --.
Line 31, delete the word “a.”.

Column 5,
Line 57, change “20” to -- 22 --.

Column 6,
Line 12 and 35, change “breakaway” to -- break-away --.
Line 50, change “exemplaiy” to -- exemplary --.

Column 8,
Line 37, after the number “4”, add -- , --.

Column 10,
Line 53, after the number “20”, add -- , --.

Column 11,
Line 7, delete the word “oriented”.

Signed and Sealed this

Twenty-fourth Day of January, 2006

JON W. DUDAS
*Director of the United States Patent and Trademark Office*